United States Patent [19]

Tomek

[11] 4,309,037

[45] Jan. 5, 1982

[54] PARLOR CHECKERBOARD GAME

[76] Inventor: Ivan V. Tomek, 10910 Poitras, app. 308, Mt1-North, Prov. of Quebec, Canada, H1H 5J4

[21] Appl. No.: 187,951

[22] Filed: Sep. 16, 1980

[51] Int. Cl.[3] ..... A63F 3/00

[52] U.S. Cl. ..... 273/261

[58] Field of Search ..... 273/255, 258, 260–262; D21/24, 25, 14, 15, 16, 26–37

[56] References Cited

U.S. PATENT DOCUMENTS

| | | | |
|---|---|---|---|
| D. 33,151 | 9/1900 | Boggis | D21/35 |
| 1,184,572 | 5/1916 | Roberts | 273/262 |
| 1,315,483 | 9/1919 | Edwards | 273/262 |
| 2,316,862 | 4/1943 | Haggard | 273/262 |
| 3,977,677 | 8/1976 | Magiera | 273/255 |

FOREIGN PATENT DOCUMENTS

| | | | |
|---|---|---|---|
| 514846 | 11/1939 | United Kingdom | 273/262 |

*Primary Examiner*—Richard C. Pinkham
*Assistant Examiner*—R. Carl Moy

[57] ABSTRACT

A game to be played by two players using a board and various pieces. The board is comprised of 3 similar areas, each area a 10×10 grid. One board is a "battlefield" over which each player moves a plurality of pieces in an attempt to capture those of the opponent. Each of the other two boards is a "palace", one "palace" belonging to each player. One of each player's pieces moves over each "palace" area, these pieces moving simultaneously with the movement of certain pieces over the "battlefield" area. Paths are designated on each area to limit piece movement. To win, a player must capture his opponents piece within the player's "palace".

2 Claims, 11 Drawing Figures

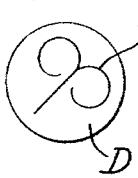
Fig. 7
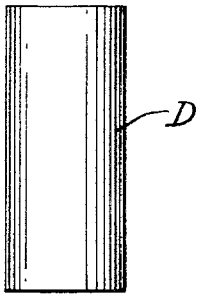
Fig. 6
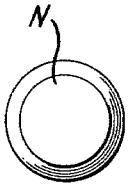
Fig. 9
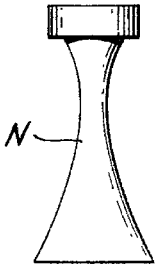
Fig. 8
Fig. 11
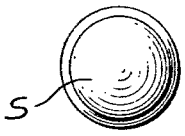
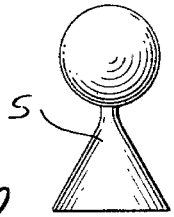
Fig. 10

PARLOR CHECKERBOARD GAME

FIELD OF INVENTION

The present invention relates to a parlor game of a strategic character and to be played by two players. The element of chance does not intervene in the game.

SUMMARY OF THE INVENTION

The parlor game of the present invention comprises two series of playing pieces of distinct color and a playing board on which are inscribed three square-shaped distinct playing zones, each marked with a particular series of paths for the playing pieces, a specific group of playing pieces playable in each zone and the movements of certain pieces in one particular zone controlling the movement of other playing pieces in the other two zones.

The foregoing will become clearer by referring to the annexed drawings and to the following detailed description.

BRIEF DESCRIPTION OF THE DRAWINGS

FIG. 6 is an elevation of a playing piece called the Duke;

FIG. 7 is a top plan view of the playing piece of FIG. 6;

FIG. 8 is an elevation of the playing piece, called the Noble;

FIG. 9 is a top plan view of the playing piece of FIG. 8;

FIG. 10 is an elevation of the playing piece, called Soldier; and

FIG. 11 is a top plan view of the playing piece of FIG. 10.

DETAILED DESCRIPTION OF THE DRAWINGS

Figure 1:
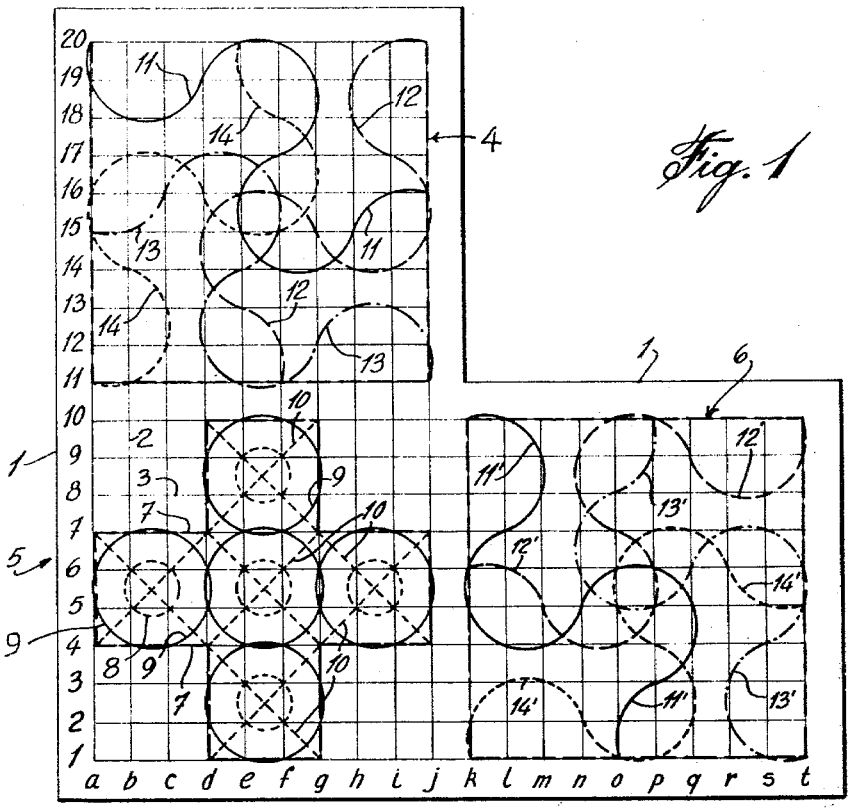
FIG. 1 is a top plan view of the playing board.

Referring to FIG. 1, there is shown in plan view a playing board 1 inscribed with a checker-board formed of two series of equally-spaced parallel, straight lines intersecting themselves at right angles. The vertical lines 2 are identified by the abscissa symbols a to t, while the horizontal lines 3 are identified by the ordinates 1 to 20. Three separate playing zones 4, 5, and 6 are marked on the playing board. The coordinates of the corners of the imaginary square defining the first playing zone 4 are indicated at all, a20, j20, and j11. The coordinates of the imaginary square defining the second playing zone 5 are a1, a10, j10, and j1. The coordinates of the imaginary square defining the third playing section or zone 6 and k1, k10, t10, and t1. It will therefore be noted that the first and second playing zones 4 and 5 are vertically aligned, while the second and third playing zones 5 and 6 are horizontally aligned. Playing paths are formed in each playing zone.

Referring to the second playing zone 5, there is marked a first network of playing paths for the playing pieces, comprising a playing path 7 in the form of a four-legged cross, this cross being defined by a central square and by four lateral squares, each forming one leg of the cross. The playing path 7 is defined by the following coordinates: a4, a7, d7, d10, g10, g7, j7, j4, g4, g1, d1, and d4. The first network of playing paths, include also the vertical lines 2 and horizontal lines 3 and their intersections, which are situated within the cross-shape playing path 7. There is a second playing path in each of the five squares of the cross-shape figure and each passing through the four intersections points located in the center of the respective square. More particularly, in the left-hand square in playing zone 5, the second playing path 8 can be in the form of a circle and has, at any rate, the following coordinates: b5, b6, c6, c5. Similarly, we find a second playing path 8 defined by the coordinates e8, e9, f9, f8; also at h5, h6, i6, and i5; also at e2, e3, f3, and f2; and, finally, at e5, e6, f6, and f5. There is inscribed a third playing path for each of the five squares of the cross and determined by the following coordinates: a5, a6, b7, c7, d6, d5, c4, and b4; also d8, d9, e10, f10, g9, g8, f7, and e7; also g5, g6, h7, i7, j6, j5, i4, and h4; also d2, d3, e4, f4, g3, g2, f1 and e1; and, finally, d5, d6, e7, f7, g6, g5, f4, and e4. Each of these third playing paths is, preferably, in the form of circles 9 concentric with the smaller circles 8. There is finally a network of fourth playing paths, indicated at 10, and constituting two diagonals for each of the five squares of the cross-shape playing path 7, the network of the fourth playing paths being defined by the following coordinates: d1, j7; also d4, g7; also a4, g10, also a7, g1; also d7, g4, and d10, j4.

It will be noted that the first, second, third and fourth playing paths are of distinctive colors.

The first playing zone 4 comprises a network of four fifth playing paths, indicated at 11, 12, 13 and 14, respectively. The fifth playing paths 11 to 14 are all of identical shape, but oriented at 90° one with respect to the other and each starting at one of the four corners of the imaginary square of the first playing zone 4. Playing path 11 is identified by the following coordinates: a20, a19, b18, c18, d19, e20, f20, g19, g18, f17, e16, e15, f14, g14, h15, i16 and j16. Playing path 12 starts at j20 and ends at f11. Playing path 13 starts at j11 and ends at a15. Playing path 14 starts at all and ends at e20. Playing paths 11 to 14 inclusive are preferably in the shape of a series of interconnected arcuate sections, some of them being inverted. The third playing zone 6 is similar to playing zone 4 and also includes a network of four sixth playing paths, indicated at 11', 12', 13', and 14', respectively identical in shape to the fifth playing paths 11, 12, 13, and 14, but arranged in an inverted position relative to the latter, each being composed of circular arcs, of equal radius and each joining two successive intersection points. The sixth playing paths 11', 12', 13', and 14' are all oriented at 90° one with respect to the other and each starts at one of the four corners of the imaginary square formed by the third playing zone 6. The coordinates of the first one, namely: playing path 11', are as follows: k10, 110, m9, m8, 17, k6, k5, 14, m4, n5, o6, p6, q5, q4, p3, o2, and o1. The sixth playing path 12' starts at t10 and ends at k6. Playing path 13" starts at t1 and terminates at p10 while playing path 14' starts at k1 and terminates at t5.

Figure 3:
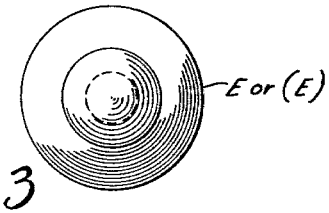
FIG. 3 is a top plan view of the playing piece of FIG. 2.
Figure 5:
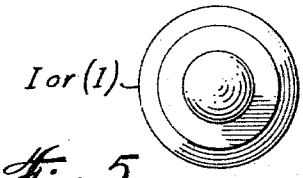
FIG. 5 is a top plan view of the playing piece of FIG. 4.
Figure 2:
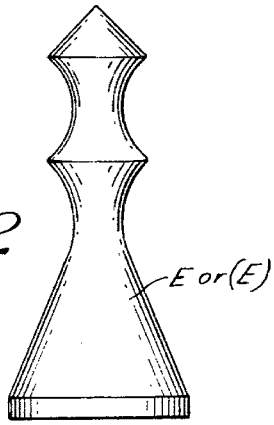
FIG. 2 is an elevation of one playing piece, called the Emperor, and representing also another playing piece, called the Prince.
Figure 4:
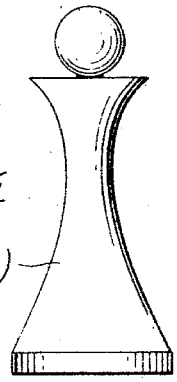
FIG. 4 is an elevation of the playing pieces, called the Empress and the Princess.

The game further includes two series of playing pieces and each series is composed of eighteen playing pieces forming seven different types. The playing pieces of one set are all of the black color, while the playing pieces of the other set are all of the white color. In each set of eighteen pieces, there is one Emperor, one Empress, one Prince, one Princess, two Dukes, four Nobles and eight Soldiers. FIGS. 2 and 3 represent the shape of the Emperor and of the Prince in each camp and having the notation E,(E) respectively. FIGS. 4 and 5 represent the shape of the playing piece called the Empress and also the playing piece called the Princess, and having notation I, (I) respectively. FIGS. 5 and 6 show the shape of the playing piece called the Duke, in the form of a cylinder and having notation D. The top of the piece bears a symbol, indicated at 15, and of white color, if the playing piece is black, and black color if the playing piece is white. As said before, there are two Dukes in each camp. FIGS. 8 and 9 show the form of the playing piece called the Noble and characterized by notation N of four Nobles per camp. FIGS. 10 and 11 show the playing piece called the Soldier and characterized by notation S. There are eight Soldiers per camp. The game is played in accordance with the following rules:

The game is played by two players and each alternates with the other; one plays with white pieces and the other with the black pieces. The game symbolizes a conflict between two Empires: the whites and the blacks. In the palace of the white Prince, is located the black Princess, and in the palace of the black Prince, is located the white Princess, at the moment where the Emperor and Empress armies of the two camps are on the battle-field. The Emperors and Empresses decide that the victor will be the one camp which will first succeed either to extract the Princess from the palace of the enemy Prince before the latter can cath the Princess, or the Prince will first catch the enemy Princess before the latter can escape from the palace. The Emperors, while moving, direct the movements of their sons, the Princes, and the Empresses, when moving, direct the movements of their daughters, the Princesses, by projecting their own movements on the battle-field within the respective palaces. The armies facilitate this action by causing obstacles to the movements of the enemy Emperor and Empress who remain, however, untouchable and by eliminating the potential of the enemy army.

The game takes place on the three playing zones 4, 5, and 6. The second playing zone 5 is the battle-field; the first playing zone 4 is the palace of the white Prince and the third playing zone 6 is the palace of the black Prince; the playing pieces are always placed, at the start of the game and after having effected a movement along the respective playing paths, as above described, at the intersections of the playing path with a vertical line 3 and horizontal line 2.

The position of the playing pieces on the second playing zone 5, namely the battle-field at the start of the game, is as follows: white camp—Emperor E at j4; Empress I at g1; the two Dukes D at e1 and j6, respectively; the four Nobles N at d1, f1, j5, and j7, respectively; the eight Soldiers S at d2, e2, f2, g2, i4, i5, i6, and i7, respectively. In the black camp, Emperor E at d10; Empress I at a7, the two Dukes at a5 and f10, the four Nobles at a4, a6, e10, and g10; the eight Soldiers at b4, b5, b6, b7, d9, e9, f9, and g9. The position of the playing pieces at the start of the game within the palace of the black Prince, namely in playing zone 6, is as follows: black Prince (E) at k10; white Princess (I) at t1. At the start of the game, the position of the playing pieces in the palace of the white Prince defined by playing zone 4, is as follows: white Prince (E) at j11 and black Princess (I) at a20.

One rule for all the playing pieces is as follows: the pieces can move only within the playing zones in which they are originally located. The term: Capture a Playing Piece means removing a playing piece of the enemy camp from the respective playing zones. Capture is not obligatory. The Emperors and Empresses cannot capture and cannot be captured. A Prince can capture an enemy Princess but cannot be captured by the latter. The Dukes, Nobles and Soldiers can be captured and can capture an enemy piece. An intersection point can only be occupied by one playing piece.

Referring to the playing zone 5, namely the battle-field, the playing path 7 will be assumed to be of black color; the playing paths 8 and 10 will be assumed as being of the blue color, while the playing path 9 will be assumed as being of the red color. Therefore, intersection points denoted as red points will signify the intersection points of all the black lines with the red lines; and the intersection points denoted as blue points will signify all the intersection points of the black lines with one or more blue lines.

RULES CONCERNING THE MOVEMENTS OF THE SOLDIERS

Each soldier can move one or two points in all directions and while following either one of the following paths:

(a) a red circle, namely playing path 9, from which he accomplishes his movement. If the starting point is at the intersections of two red circles, namely two playing paths 9, he can choose anyone of these red circles to effect his movement. When advancing two points, he cannot move over a point already occupied by a playing piece of his own camp, or of the enemy camp. He cannot capture a playing piece when effecting a movement along the red lines;

(b) a blue line, namely playing paths 8 or 10, namely by following a diagonal line in a direct movement or by following a blue circle. When advancing two points, he cannot go over a point occupied by a friendly or enemy playing piece. He cannot capture a piece when effecting a movement along the blue lines;

(c) a black line in a direct movement. When advancing two points, he cannot move over a point occupied by a friendly piece. When advancing two points, if the first point is occupied by an enemy piece, he can capture the latter by jumping over the same and stopping on the second point. This constitutes the only manner of capturing an enemy piece.

RULES CONCERNING THE MOVEMENTS OF THE NOBLES

Each Noble moves in two ways:

(a) in all directions, by following a black line in a direct movement up to the end of the line or by stopping on one of the intersection points of this line. By effecting these movements, he cannot move over a point already occupied by a friendly or enemy piece. He cannot capture any piece while effecting a movement along these black lines.

(b) To capture an enemy piece, he moves:

(i) In all directions by following the red circle from which he starts and by stopping on one point of the red circle already occupied by an enemy piece. If the starting point is at the intersections of two red circles, he can choose either of these red circles to effect his movement. While effecting one of the above-mentioned movements, he cannot move over a point already occupied by a friendly or enemy piece. He can effect the movements on the red circles only for capturing an enemy piece;

(ii) In all directions along a blue line, either by following a diagonal in a direct movement and by stopping on a point of this blue line occupied by an enemy piece; or if the starting point is on a blue circle, by following this blue circle and stopping on one point already occupied by an enemy piece. While effecting one of these movements, he cannot move over a point already occupied by a friendly or enemy piece. He can effect these movements along the blue lines only for capturing an enemy piece. In the case where the Noble is on a point from which starts:

(a) either a blue line or a black line, each leading to a point towards which a Noble desires to effect his movement:

(b) either one or two red lines and a black line all leading to a point towards which the Noble desires to effect his movement, the Noble can advance towards this point without capturing a piece, if the point is free, or for capturing a piece if the point is occupied.

RULES CONCERNING THE MOVEMENTS OF THE DUKES

The Duke moves:

(i) In all directions by following a red line, either by moving all around the red circle on which he starts or by stopping on one of the intersection points of the latter. If the starting point is at the intersection of two red circles, he can choose one of these red circles to effect his above-mentioned movement. In effecting one of the above-mentioned movements, he cannot move over a point occupied by a friendly or enemy piece. He cannot capture a piece when effecting a movement along the red lines.

(ii) In all directions along a blue line, either by following a diagonal in a direct movement up to the end of the line, or by stopping on one intersection point of this line, or if the blue line from which he starts is on a circle by moving all around the circle or, while following this circle, by stopping on one point of said circle. When effecting one of the above-described movements, he cannot mover over a point already occupied by a friendly or enemy piece. He cannot capture a piece while effecting a movement along the blue lines.

(iii) In all directions following a black line in a direct movement up to the end of this black line, or by stopping along a point of this black line. While effecting one of these above-noted movements, he cannot move over a point already occupied by a friendly or enemy piece. He can capture an enemy piece by effecting a movement along the black lines. He can effect movements along the black lines without necessarily having to capture an enemy piece. When the Duke starts from a point from which originate:

(a) a blue line and a black line, each leading to a point towards which the Duke desires to effect his movement, or (b) one or two red lines and a black line, all leading to a point towards which the Duke desires to effect his movement, he can advance towards this point without capturing a piece, if the point is free, or to capture the piece if the point is occupied.

RULES CONCERNING THE MOVEMENTS OF THE EMPEROR AND OF THE PRINCE

The Emperor, from a starting point, can advance one point in all directions by following a black line, a red line or a blue line. He can only advance towards a non-occupied point. The Prince, in his own playing zone, can only advance one point in all directions while following a red line, namely: playing paths 11, 12, 13 or 14, or 11', 12', 13' or 14' in such a manner that he will effect his movements simultaneously with the Emperor of his own camp, such that the starting point of the Prince will be on the same black line as the starting point of the Emperor, and that the end point towards which the Prince moves will be on the same black line as the end point towards which the Emperor moves. Both the Emperor and the Prince movements are always effected simultaneously and are considered as a single move. The Emperor movement alone is impossible, and so is the Prince movement alone. To move the Prince, it is necessary to move the Emperor. In this manner, the Emperor directs the movements of the Prince by projecting his own movements along the red lines, which are located in the playing zone in which the Prince is positioned. In the case where the starting point and the end point of the movement of the Prince are all located on the same black line as the one on which the Emperor is positioned, then to effect the movement of the Prince, it is necessary to move the Emperor from his own starting point towards one of the two points which are located on the same black line in the vicinity of the point where the Emperor is located without having regard to the direction in which the Prince wishes to effect his movement. As an example, to effect movement of the black Prince from the starting point k6 to the end point 16, it is necessary to move the Emperor which would be located, for example, on point e6, either towards point d6 or towards point f6.

RULES CONCERNING THE MOVEMENTS OF THE EMPRESS AND OF THE PRINCESS

The Empress, from her starting point, always advances one point in all directions by following either a black line, a red line or a blue line. She can only move towards an already unoccupied point. The Princess, in the playing zone where she is located, can move from a starting point in all directions while following a red line in order to effect a movement simultaneously with the Empress of her own camp and such that the starting point of the Princess will be on the same black line as the point from which starts the Empress, and the end point of the movement of the Princess will be on the same black line as the end point of the movement of the Empress. The movements of the Empress and of the Princess are always effected simultaneously and are considered as a single movement. It is impossible to move the Empress only or to move the Princess only. In order to move the Princess, it is necessary to move the Empress. Therefore, the Empress directs the movements of the Princess by projecting her own movement on the red lines located in the playing zone where the Princess is located. In the case where both the starting and end point of the movement of the Princess are both located on the same black line on which the Empress is located, then in order to effect the movement of the Princess, the Empress must move from her starting point towards one of the end points located on the same black line in the vicinity of the starting point of the Empress and without regard to the direction in which the Princess desires to effect her movement. As an example, to effect movement of the black Princess from point e20 to point e19, the Empress must advance, for example, say, from point e7 towards either point e8 or point e6.

DEVELOPMENT OF THE GAME

The Whites always start the game. The two players play alternatively. The game ends when one of the two players wins the game, or when the game is declared null. The winner is the one who either:

(i) causes his Princess to reach one of the points called exit points, or (ii) first succeeds to have his Prince capture the enemy Princess.

The exit points for the white Princess are as follows: k1, k10, and t10.

The exit points for the black Princess are as follows: a11, j11, and j20. The game is declared null:

(i) when one of the two players whose turn it is to play cannot effect any movement with any of his playing pieces; or (ii) when the two players judge by mutual consent that they are in such a position that there is no possibility for either to win the game.

GAME NOTATION

To effect notation of the game, one uses the following notation: the minor cases abscissa letters a to t and the ordinates numbers 1 to 20 on the playing board serve to designate the positions of the playing piece. The capital letters E, I, D, N, S (E), (I) designate the playing pieces. A dash designates the movement of one piece and the X sign designates the capture of one piece. As an example, Sf2-f3 means that the Soldier moves from starting point f2 to end point f3. Nd3XX De4 means that a Noble starting on point d3 captures a Duke positioned on point e4.

EXAMPLE OF THE NOTATION FOR THE START OF THE GAME

1. Sf2-d4 Se9-g7
2. Nf1-f5 Ne10-e7
3. Ig1-f1 (I) t1-s1 E d 10-e 10 (E) K10-1 10

Therefore:

3. I g1-f1 (I) t1-s1
E d10-e10 (E) k10-10 means that the Whites have effected a third play by moving both the Empress and the Princess, and that the Blacks have effected a third play by moving the Emperor and the Prince.

What I claim is:

1. A parlor game to be played by two players and comprising:

(a) two sets of playing pieces of two distinct colors;

(b) a playing board on which is inscribed:

1. a checkerboard formed of two series of equally-spaced parallel straight lines intersecting themselves at right angles and the intersection points of which constitute starting points and end points of the playing pieces, said intersection points being identified by an abscissa scale and an ordinate scale;
2. three distinct playing zones, each inscribed in an imaginary square on said playing board and each composed of ten abscissa lines and ten ordinate lines, the first and second playing zones being aligned along the abscissa lines and the second and third playing zones being aligned along the ordinate lines, the three playing zones being disposed on the said checkerboard in accordance with the following coordinates in which the scale of ordinates is expressed by the numbers 1 to 20, and the scale of the abscissa by the letters a to t, the corners of the imaginary square of the first playing zone being defined by coordinates a11, a20, j20, and j11; the corners of the imaginary square of the second playing zone being a1, a10, j10, and j1; the corners of the imaginary square of the third playing zone being k1, k10, t10, and t1;
3. The second playing zone being inscribed with:

(i) a network of first playing paths for said playing pieces comprising a playing line in the form of a cross with four branches, said cross being defined by a central square and four other squares forming each one of the four branches, said first playing line being identified by the following coordinates: a4, a7, d7, d10, g10, g7, j7, j4, g4, g1, d1, and d4, the network including all of the abscissa and ordinate lines located inside said cross and also all the intersection points of the abscissa and ordinate lines situated within said cross;

(ii) a second playing path in each of said five squares of said cross and each extending through the four intersection points located in the center of the respective squares;

(iii) a third playing path for each of said five squares of the said cross and the coordinates of which are as follows: a5, a6, b7, c7, d6, d5, c4, and b4; also d8, d9, e10, f10, g9, g8, f7, and e7; also g5, g6, h7, i7, j6, j5, i4, and h4; also d2, d3, e4, f4, g3, g2, f1, and e1; and also d5, d6, e7, f7, g6, g5, f4, and e4;

(iv) a network of fourth playing paths constituting diagonals for each of said squares and each fourth playing path being a straight line, the coordinates of which are as follows: d1, j7; also d4, g7; also a4, g10; also a7, g1; also d7, g4, and d10 j4; the first, second, third and fourth playing paths being each of a distinctive color;

4. said first playing zone comprising a network of four fifth playing paths, all identical but oriented at 90° one with respect to the other and each starting at one of the four corners of the imaginary square of said first playing zone, the first one of said fifth playing paths being identified by the following coordinates: a20, a19, b18, c18, d19, e20, f20, g19, g18, f17, e16, e15, f14, g14, h15, i16, and j16, the second one of said fifth playing paths starting at j20 and ending at f11; the third one of said fifth playing paths starting at j11 and ending at a15; and the fourth one of said fifth playing paths starting at all and terminating at e20;
5. the third playing zone also including a network of four sixth playing paths, the shape of which is identical to the fifth playing paths but disposed in inverted position with respect to the fifth playing paths, the said sixth playing paths being also oriented at 90° one with respect to the other and each starting at one of the four corners of the imaginary square of the third playing zone, the coordinates defining the first of said sixth playing paths being k10, 110, m9, m8, 17, k6, k5, 14, m4, n5, o6, p6, q5, q4, p3, o2, and o1; the second of these sixth playing paths starting at t10 and ending at k6; the third of said sixth playing paths starting at t1 and ending at p10; and the fourth of said sixth playing paths starting at k1 and ending at t5;

(c) each set of playing pieces including eighteen playing pieces distributed in seven categories as follows: one piece each for the first, second, third and fourth categories; two pieces for the fifth category; four pieces for the sixth category; and eight pieces for the seventh category, all pieces of the two sets, except the pieces of the third and fourth categories, being adapted to be played only on the playing paths of the second playing zone and in accordance with different movements for each category, the piece of the third category of one set of pieces and the piece of the fourth category of the other set of pieces being adapted to be played only on the playing paths of the first playing zone, and the piece of the third category of the other set and the piece of the fourth category of the one set being adapted to be played only on the playing paths of the third playing zone, the pieces of the third and fourth categories of one or the other of the two sets being adapted to be moved only simultaneously and on the same abscissa and ordinate lines as the displacement of movement of the pieces of the first and second categories, respectively, and of the same set.

2. A parlor game as defined in claim 1, wherein the second and third playing paths inscribed on the second playing zones are in the form of a circle, and the fifth and sixth playing paths are composed of arcs of circles of equal radius, and these arcs of circles join two successive intersection points.

* * * * *